United States Patent [19]

Nakamura et al.

[11] Patent Number: 4,545,758

[45] Date of Patent: Oct. 8, 1985

[54] POT-TYPE OIL BURNER

[75] Inventors: Kazuharu Nakamura; Motoki Matsumoto; Tooru Yoshino; Yoshimasa Tsuboi, all of Aichi, Japan

[73] Assignee: Toyotomi Kogyo Co., Ltd., Aichi, Japan

[21] Appl. No.: 491,623

[22] Filed: May 5, 1983

[30] Foreign Application Priority Data

May 28, 1982 [JP] Japan ..... 57-91830

[51] Int. Cl.[4] ..... F23D 11/02; F23D 11/44

[52] U.S. Cl. ..... 431/208; 431/258; 431/260; 431/333; 431/334; 431/170; 126/144

[58] Field of Search ..... 431/208, 258, 260, 333, 431/334, 335, 336, 337, 338, 340, 341, 170; 126/95, 93, 144, 595

[56] References Cited

U.S. PATENT DOCUMENTS

| | | | |
|---|---|---|---|
| 1,968,360 | 7/1934 | Sturgis | 431/208 |
| 2,073,552 | 3/1937 | Curioni | 431/260 |
| 2,337,734 | 12/1943 | Breese | 431/340 |
| 2,486,481 | 11/1949 | Kissam | 126/93 |
| 2,647,567 | 4/1953 | Ciglia | 431/208 |
| 3,099,258 | 7/1963 | Kurz | 126/93 |
| 3,653,794 | 4/1972 | Shakiba | 431/208 |
| 4,141,505 | 2/1979 | Reich | 431/208 |
| 4,402,664 | 9/1983 | Kutrieb | 426/93 |

FOREIGN PATENT DOCUMENTS

| | | | |
|---|---|---|---|
| 21084 | 4/1963 | Japan . | |
| 23645 | 5/1966 | Japan . | |
| 3346 | 3/1968 | Japan . | |
| 18026 | 6/1971 | Japan . | |
| 32466 | 11/1971 | Japan . | |
| 37895 | 12/1975 | Japan . | |
| 25796 | 7/1976 | Japan . | |
| 14421 | 4/1978 | Japan . | |
| 0053610 | 4/1980 | Japan | 431/208 |
| 0118507 | 9/1980 | Japan | 431/340 |
| 1304307 | 1/1973 | United Kingdom | 431/208 |

*Primary Examiner*—Samuel Scott
*Assistant Examiner*—Helen A. Odar
*Attorney, Agent, or Firm*—Pollock, Vande Sande & Priddy

[57] ABSTRACT

A pot-type oil burner is disclosed which is capable of effectively preventing the generation of bad odor and soot during the igniting operation by turning on an electric heater positioned above a heat-resistant fabric spread on the bottom surface of a pot to previously heat the pot and fabric to a temperature sufficient to vaporize fuel oil prior to introducing fuel oil to the pot by means of a nozzle pipe.

18 Claims, 2 Drawing Figures

TIMER
60c
TO PUMP 40
TO HEATER 60
TO FAN 28
TEMPERATURE RESPONSIVE CONTROLLER
60b
10
12
14
16
18
20
22
24
26
28
30
32
34
36
38
40
46
48
50
52
54
56
58
60

POT-TYPE OIL BURNER

BACKGROUND OF THE INVENTION

1. Field of the Invention

This invention relates to an improved pot-type oil burner, and more particularly to a pot-type oil burner which is adapted to effectively prevent the generation of bad odor and soot and at the time of ignition.

2. Description of the Prior Art

There has been conventionally known a pot-type oil burner in the art which is constructed to arrange an ignition heater in a pot to ignite fuel oil supplied to the pot. However, the conventional oil burner of such type has a disadvantage that fuel oil is often discharged in noncombustion and incomplete combustion states, followed by the generation of bad odor and soot, because the vaporization of fuel oil in a pot is apt to become unstable to cause a combination flame to be nonuniformly spread. Thus, in the conventional pot-type oil burner it is required to exhaust a combustion gas through an exhaust pipe to the exterior.

BRIEF SUMMARY OF THE INVENTION

The present invention has been made in view of the foregoing disadvantage of the prior art.

Accordingly, it is an object of the present invention to provide a pot-type oil burner which is capable of carrying out a regular combustion immediately after the ignition to effectively prevent the generation of soot and bad odor during the ignition operation.

It is another object of the present invention to provide a pot-type oil burner which is capable of forming a combustible gas sufficient to allow a regular complete combustion to be initiated immediately after the ignition.

It is still a further object of the present invention to provide a pot-type oil burner which is capable of keeping an excellent ignition performance and the appearance of a regular complete combustion just after the ignition for a long period of time.

In accordance with the present invention, there is provided a pot-type oil burner comprising a pot carrying out at least the vaporization of a fuel oil supplied thereto; a heat-resistant fabric spread on the bottom surface of the pot; a heating means arranged in the pot so as to be positioned above the fabric, the heating means acting to heat the pot and fabric to vaporize a fuel oil supplied to the pot and ignite the vaporized fuel oil; and a nozzle means extending into the pot to introduce fuel oil from an oil supply means therethrough to the pot; wherein the supply of fuel oil from the nozzle means to the pot is started in a predetermined time after the heating means is turned on.

In a preferred embodiment of the present invention, the supply of fuel oil to the pot is started after the pot and heat-resistant fabric are heated to a temperature sufficient to vaporize the fuel oil. Fuel oil is preferably ejected under pressure or together with air to be uniformly dispersed in the form of finer particles on the entire surface of the fabric. Furthermore, the fabric may have a suitable oxidation catalyst carried thereon.

BRIEF DESCRIPTION OF THE DRAWINGS

Other objects and many of the attendant advantages of the present invention will be readily appreciated as the same becomes better understood by reference to the following detailed description when considered in connection with the accompanying drawing, wherein.

DETAILED DESCRIPTION OF THE PREFERRED EMBODIMENT

Figures 1, 2:
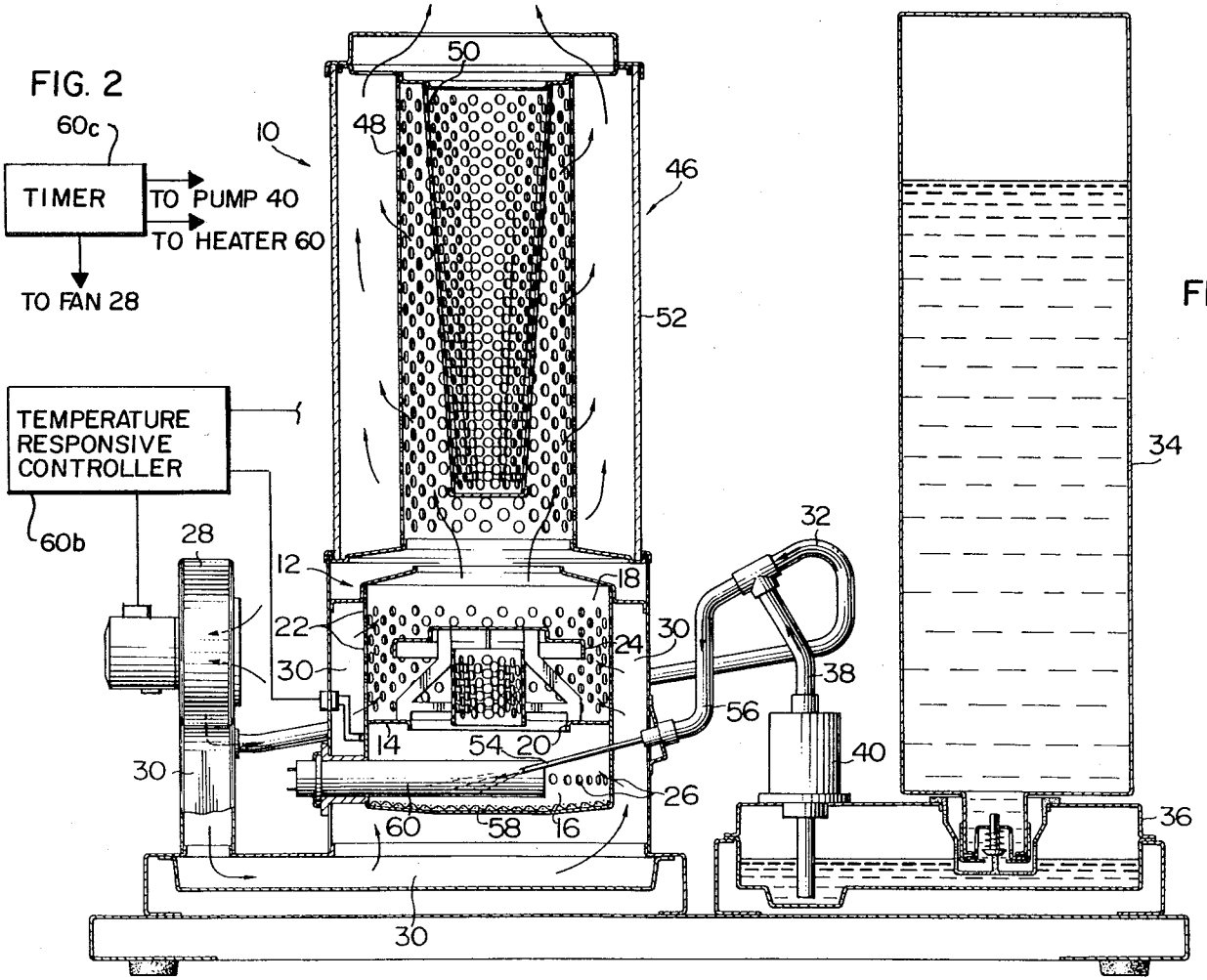
FIG. 1 is a vertical sectional view showing an embodiment of a pot-type oil burner according to the present invention.
FIG. 2 is a fragmentary schematic of a timer controller of a pot-type oil burner according to the present invention.

Now, a pot-type oil burner according to the present invention will be described hereinafter with reference to the accompanying drawing.

Referring to the figure, a pot-type oil burner is generally designated by reference numeral 10. The oil burner illustrated is a red-hot type space heater, however, it should be noted that an oil burner of the present invention is not limited to such red-hot type burner.

The oil burner 10 includes a cylindrical pot 12 which is adapted to carry out the vaporization of fuel oil such as kerosene supplied thereto. In the embodiment illustrated, the pot 12 has a horizontal partition 14 arranged therein by which the pot 12 is divided into a lower chamber 16 and an upper chamber 18 communicated with each other through an opening 20 formed at the central portion of the partition 14. The lower chamber 16 acts as a vaporization chamber for vaporizing fuel oil supplied thereto and the upper chamber 18 acts as a mixing chamber for mixing vaporized fuel oil with air to form a combustible gas. The upper chamber 18 is provided at the side wall thereof with a plurality of through-holes 22 which serve to introduce therethrough into the chamber 18 air necessary to form a combustible gas and burn the combustible gas in a combination chamber. The upper chamber 18 also has a mixing means 24 provided therein, which is positioned above the opening 20. The mixing means 24 acts to form a combustible gas in the upper chamber 18 by uniformly diffusing in the chamber 18 a fuel oil vaporized in the lower chamber 16 and allowing the diffused oil to be mixed with air supplied via the through-holes 22 to the chamber 18. The lower chamber 16 is also provided at the side wall thereof with through-holes 26 for introducing air thereto, so that the chamber 16 may accomplish ignition of vaporized fuel oil as well as the vaporization. Thus, it will be noted that in the embodiment illustrated, the pot 12 carries out the vaporization, mixing and ignition of fuel oil.

The oil burner 10 also includes an air supply means for supplying air to the pot 12 which comprises an air fan 28 provided at the outside of the burner and an air supply passage 30 defined in the burner and connected to the fan, the passage 30 being communicated with the interior of the pot 12 via the through-holes 22 and 26 of the pot and an air supply pipe 32 connected between the passage 30 and the pot.

Furthermore, the oil burner 10 includes an oil supply means for supplying fuel oil to the pot 12, which comprises an oil tank 34 and an oil reservoir 36. The oil reservoir 36 is constructed to support the tank 34 in an inverted manner and keep the level of fuel oil therein substantially constant. The oil reservoir 36 is communicated with the pot 12 through an oil supply pipe 38 so as to supply fuel oil from the reservoir 36 to the pot. In the embodiment illustrated, fuel oil is supplied by means of an electromagnetic pump 40 provided between the oil supply pipe 38 and the reservoir 36.

Above the pot 12, a combustion chamber 46 is disposed which acts to burn therein a combustible gas formed in the upper chamber 18 of the pot 12 utilizing combustion air supplied from the air passage 30 via the through-holes 22 thereto and heat of fuel oil ignited and burned in the pot 12. The combustion chamber 46 has an outer perforated combustion cylinder 48 and an inner perforated combustion cylinder 50 each formed of a ceramic material. A combustible gas supplied to the combustion chamber 46 is burned on the outer surface of the inner cylinder 50 and the both surfaces of the outer cylinder 48 to red-heat the cylinders 48 and 50, to thereby allow the cylinders to emit heat rays. Reference numeral 52 designates a transparent heat-permeable cylinder disposed around the outer combustion cylinder 48 and formed of a heat-resistant glass through which heat rays emitted from the cylinders 48 and 50 are discharged to the exterior of the burner.

One of essential features of an oil burner of the present invention is that the oil supply pipe 38 is provided at the end portion thereof extending to the pot 12 with a nozzle pipe 54, which extends into the pot to allow fuel oil to be ejected in the form of fine particles into the pot 12. It is preferable that fuel oil ejected from the nozzle 54 is dispersed on the bottom surface of the pot as uniformly and widely as possible in the form of fine particles. For this purpose, the embodiment is constructed in a manner such that the air supply pipe 32 and oil supply pipe 38 merge into a single pipe 56 extending to the pot to allow fuel oil to be supplied to the pot together with air and the nozzle is formed at the end of the single pipe 56. This allows drizzle-like fuel oil carried on air to be sprayed on the entire bottom surface of the pot at a high velocity.

Another feature of the present invention is that a fabric 58 formed of a heat-resistant fiber such as a silica fiber, an asbestos fiber or the like is put down on the bottom surface of the pot and an electric heater 60 is arranged above the fabric 58. The fabric 58 is preferably a woven fabric although it may be a non-woven fabric. It is preferable that the fabric 58 is spread on substantially the entire bottom surface of the pot and the heater 60 is disposed just above the fabric. Such feature allows fuel oil to be dispersed on the fabric to have a larger surface area. Also, such construction permits the fabric and pot to be readily heated to a high temperature. Thus, fuel oil can be readily and uniformly vaporized and continuously supplied to the combustion chamber 46. The fabric 58 is preferably formed into a fine reticulate shape to have a large area. The fabric may have a suitable catalyst such as platinum or the like carried thereon. The heater 60 is preferably formed of a ceramic material into a bar-like shape which has a heating element embedded in the outer periphery thereof, so that it may have good durability and utility.

A further feature of the present invention is that the heater 60 is turned on after the fabric 58 and pot 12 are heated, preferably to a high temperature sufficient to vaporize fuel oil. This allows vaporized fuel oil to be continuously supplied to the combustion chamber from the start without any condensation in the pot. This may be carried out, for example, by connecting any suitable temperature sensor **60*a* and a temperature responsive controller 60*b* between the pot 12 and the electromagnetic pump 40 and air fan 28, to allow the controller to actuate the pump 40 and air fan 28 when a predetermined temperature has been reached at pot 12. Alternatively, this may be accomplished as shown in FIG. 2 by connecting a timer 60*c* among the heater 60, the pump 40 and the fan 28 to permit the timer to actuate the pump and fan in predetermined time, for example, three minutes after the heater 60** is turned on.

Now, the manner of operation of the pot-type oil burner will be explained hereinafter.

First, the heater 60 is turned on to heat the pot 12 and fabric 58 to a temperature sufficient to vaporize fuel oil. Then, the air fan 28 and electromagnetic pump 40 are actuated to eject fuel oil in the form of fine particles from the nozzle pipe 54 onto the entire surface of the heated fabric 58 to instantly and uniformly vaporize a fuel oil. The vaporized fuel oil is constantly supplied to the upper chamber 18 of the pot without causing condensation of the vaporized fuel oil in the pot because the pot is previously heated to a high temperature, so that it may be mixed with air supplied through the holes 22 to readily form a combustible gas sufficient to allow a regular complete combustion. Further, a part of the vaporized fuel oil is ignited by the heater utilizing air introduced via the through-holes 26 into the lower chamber 16 of the pot and is supplied to the combustion chamber 46 together with the combustible gas. Thus, a regular complete combustion is initiated immediately after the ignition.

As can be seen from the foregoing, the present invention is adapted to eject fuel oil in the form of fine particles from the nozzle onto the entire surface of the previously heated fabric to continuously and uniformly vaporize a fuel oil; thus, it is possible to effectively prevent uncombustion or incomplete combustion due to the local supply of fuel oil, unsufficient mixing of vaporized fuel oil with air and/or unsufficient heating of the pot, so that the complete combustion may be always carried out just after the ignition to effectively prevent the generation of bad odor and soot.

In the present invention, the nozzle pipe may be arranged to allow drizzle-like fuel oil ejected therefrom to be sprayed on the entire surface of the fabric. This allows fuel oil to be more uniformly vaporized to from a combustible gas sufficient to carry out a regular complete combustion immediately after the ignition.

The fabric may have an oxidation catalyst carried thereon. This permits fuel oil to be readily vaporized even if a fuel oil of bad quality is used. Also, this significantly reduces retention of tar in the pot. Thus, it is possible to keep an excellent ignition performance and the appearance of a regular complete combustion just after the ignition for a long period of time.

As many apparently widely different embodiments of this invention may be made without departing from the spirit and scope thereof, it is to be understood that the invention is not limited to the specific embodiment thereof except as defined in the appended claims.

What is claimed is:

1. A pot-type oil burner comprising:

a pot for carrying out the vaporization, mixing, ignition and combustion of fuel oil supplied thereto;

a heat-resistant fabric spread on the bottom surface of said pot;

a heating means, arranged in said pot and positioned above said fabric, for heating said pot and said fabric to vaporize fuel oil supplied to said pot, said heating means being positioned sufficiently close to said fabric to cause ignition and burning of fuel oil vaporized by said fabric;

a nozzle means extending into said pot for introducing fuel oil from an oil supply means therethrough into said pot and onto said fabric;

sensor means for providing a time delay between turning on said heating means and starting the supply of said fuel oil from said nozzle means to said pot, said time delay being sufficient for said heating means to heat said pot and said fabric to a temperature sufficient to vaporize said fuel oil; and, means responsive to said sensor means for starting the supply of fuel oil from said nozzle means to said pot after said heating means is turned on and said pot and fabric have been heated to a temperature sufficient to vaporize said fuel oil.

2. A pot-type oil burner as defined in claim 1, wherein fuel oil is ejected from said nozzle means together with air.

3. A pot-type oil burner as defined in claim 2, wherein said nozzle means is arranged at the end portion of a single pipe into which an air supply pipe and an oil supply pipe merge and is positioned above said fabric.

4. A pot-type oil burner as defined in claim 3, wherein said fabric is formed into a reticulate shape and has an oxidation catalyst carried thereon.

5. A pot-type oil burner as defined in claim 2, wherein said fabric is formed into a reticulate shape and has an oxidation catalyst carried thereon.

6. A pot-type oil burner as defined in claim 1, wherein said fabric has a reticulate shape and has an oxidation catalyst carried thereon.

7. A pot-type oil burner as claimed in claim 1 in which said sensor means includes means for sensing the temperature of said pot.

8. A pot-type oil burner as defined in claim 1 in which said sensor means includes means for starting the supply of fuel oil from said nozzle means to said pot at a predetermined time after said heating means is turned on.

9. A pot-type oil burner comprising:

a pot, having a plurality of through-holes formed at the side wall thereof, for carrying out the vaporizing, mixing, igniting and burning of fuel oil supplied thereto;

a heat resistant fabric spread on the bottom surface of said pot;

a heating means, arranged in said pot and positioned above said fabric, for heating said pot and said fabric to vaporize fuel oil supplied to said pot, said heating means being positioned sufficiently close to said fabric to cause ignition and burning of fuel oil vaporized by said fabric;

a nozzle means extending into said pot for introducing fuel oil therethrough to the pot so as to spray the fuel oil onto said fabric, said nozzle means being provided at the end portion of a single pipe into which an oil supply pipe and an air supply pipe merge;

sensor means for providing a time delay between turning on said heating means and starting the supply of said fuel oil from said nozzle means to said pot, said time delay being sufficient for said heating means to heat said pot and said fabric to a temperature sufficient to vaporize said fuel oil; and, means responsive to said sensor means for starting the supply of fuel oil from said nozzle means to said pot after said heating means is turned on for a period of time sufficient to heat said pot and said fabric to a temperature sufficient to vaporize said fuel oil.

10. A pot-type oil burner as defined in claim 9, wherein fuel oil is ejected from said nozzle means together with air.

11. A pot-type oil burner as defined in claim 10, wherein said nozzle means is positioned above said fabric.

12. A pot-type oil burner as defined in claim 11, wherein said fabric is formed into a reticulate shape and has an oxidation catalyst carried thereon.

13. A pot-type oil burner as defined in claim 9, wherein said fabric is formed into a reticulate shape and has an oxidation catalyst carried thereon.

14. A pot-type oil burner as defined in claim 10, wherein said fabric is formed into a reticulate shape and has an oxidation catalyst carried thereon.

15. A pot-type oil burner as defined in claim 9 in which said sensor means includes means for sensing the temperature of said pot.

16. A pot-type oil burner as defined in claim 9 in which said sensor means includes means for starting the supply of fuel oil from said nozzle means to said pot at a predetermined time after said heating means is turned on.

17. A pot-type oil burner comprising:

a pot for carrying out the vaporization, mixing, ignition and combustion of fuel oil supplied thereto;

a heat-resistant fabric spread on the bottom surface of said pot, said fabric having an oxidation catalyst carried thereon;

a heating means, arranged in said pot and positioned above said fabric, for heating said pot and said fabric to vaporize fuel oil supplied to said pot, said heating means being positioned sufficiently close to said fabric to cause ignition and burning of fuel oil vaporized by said fabric;

a nozzle means extending into said pot for introducing fuel oil from an oil supply means therethrough into said pot and onto said fabric;

sensor means for providing a time delay between turning on said heating means and starting the supply of said fuel oil from said nozzle means to said pot, said time delay being sufficient for said heating means to heat said pot and said fabric to a temperature sufficient to vaporize said fuel oil; and, means responsive to said sensor means for starting the supply of fuel oil from said nozzle means to said pot after said heating means is turned on and said pot and fabric have been heated to a temperature sufficient to vaporize said fuel oil.

18. A pot-type oil burner comprising:

a pot, having a plurality of through-holes formed at the side wall thereof, for carrying out the vaporizing, mixing, igniting and burning of fuel oil supplied thereto;

a heat resistant fabric spread on the bottom surface of said pot, said fabric having an oxidation catalyst carried thereon;

a heating means, arranged in said pot and positioned above said fabric, for heating said pot and said fabric to vaporize fuel oil supplied to said pot, said heating means being positioned sufficiently close to said fabric to cause ignition and burning of fuel oil vaporized by said fabric;

a nozzle means extending into said pot for introducing fuel oil therethrough to the pot so as to spray the fuel oil onto said fabric, said nozzle means being provided at the end portion of a single pipe into which an oil supply pipe and an air supply pipe merge;

sensor means for providing a time delay between turning on said heating means and starting the supply of said fuel oil from said nozzle means to said pot, said time delay being sufficient for said heating means to heat said pot and said fabric to a temperature sufficient to vaporize said fuel oil; and, means responsive to said sensor means for starting the supply of fuel oil from said nozzle means to said pot after said heating means is turned on for a period of time sufficient to heat said pot and said fabric to a temperature sufficient to vaporize said fuel oil.

* * * * *